US006694547B1

(12) United States Patent
Vail

(10) Patent No.: US 6,694,547 B1
(45) Date of Patent: Feb. 24, 2004

(54) BED ENCLOSURE

(76) Inventor: Robert L. Vail, 6213 Cedar Point Rd., Oregon, OH (US) 43618

( * ) Notice: Subject to any disclaimer, the term of this patent is extended or adjusted under 35 U.S.C. 154(b) by 0 days.

(21) Appl. No.: 09/731,545

(22) Filed: Dec. 7, 2000

(51) Int. Cl.[7] ..... A47C 21/08
(52) U.S. Cl. ..... 5/424; 5/414
(58) Field of Search ..... 5/97, 414, 424, 5/512

(56) References Cited

U.S. PATENT DOCUMENTS

| | | | | | |
|---|---|---|---|---|---|
| 739,352 | A | * | 9/1903 | Schuette | 135/114 |
| 875,206 | A | | 12/1907 | Osborne | 5/414 |
| 3,763,507 | A | * | 10/1973 | Propst | 5/100 |
| 4,017,917 | A | | 4/1977 | Brown | 5/60 |
| 4,641,387 | A | | 2/1987 | Bondy et al. | 5/508 |
| 4,959,878 | A | | 10/1990 | Essek | 5/424 |
| 5,384,925 | A | | 1/1995 | Vail | 5/424 |
| 5,784,732 | A | | 7/1998 | Vail | 5/430 |
| 6,216,291 | B1 | * | 4/2001 | Eads et al. | 135/121 |
| 6,263,529 | B1 | * | 7/2001 | Chadwick et al. | 5/414 |
| 6,487,735 | B1 | * | 12/2002 | Jacques et al. | 5/424 |

OTHER PUBLICATIONS

Vail Enclosed Bed Systems (4–page brochure) (admitted as prior art).
The Vail 1000 Enclosed Bed (2–page brochure) (admitted as prior art).
Vail 2000 Enclosed Bed (4–page brochure) (admitted as prior art).

* cited by examiner

*Primary Examiner*—Michael F. Trettel
(74) *Attorney, Agent, or Firm*—MacMillan, Sobanski & Todd, LLC

(57) ABSTRACT

A bed enclosure includes a bed which is adapted to move up and down relative to a resting surface beneath the bed, and an enclosure which encloses at least the occupant portion of the bed. The enclosure is adapted to move up and down with the bed. Another embodiment of a bed enclosure includes a bed and an enclosure which comprises a plurality of panels. At least one of the panels is removably attached to the enclosure.

14 Claims, 9 Drawing Sheets

BED ENCLOSURE

BACKGROUND OF THE INVENTION

This invention relates in general to bed enclosures and in particular to an improved structure for such a bed enclosure.

In some medical treatment situations, it is sometimes necessary (or preferred) to physically restrain certain patients in order to provide protection for themselves and/or others. For example, adults and children having dementia, psychiatric or mental disorders, or other kinds of mental and/or physical problems may need to be restrained. In the past, these people have been physically restrained by using ties, straps, or vests. However, the use of these kinds of restraints can cause psychological and physical harm, can cause severe discomfort, and can impede emergency treatment. In addition, these kinds of restraints must frequently be removed during the day for a variety of reasons, such as to allow the person to exercise his or her muscles, or to clean or feed the person.

One alternative to using physical restraints involves using a bed enclosure. Typically, the bed enclosure includes a supporting frame and a netted covering which extends over the sides and top of the frame. The netted covering is provided with zippered areas which can be readily opened and closed in order to provide access to the interior of the enclosure. Thus, the bed enclosure provides a more humane, safe, and less restrictive environment for the person.

SUMMARY OF THE INVENTION

This invention relates to a bed enclosure including a bed which is adapted to move up and down relative to a resting surface beneath the bed, and an enclosure which encloses at least the occupant portion of the bed. The enclosure is adapted to move up and down with the bed. Thus, the bed enclosure of the invention can be raised or lowered, for example, to treat the patient or to make it easier for the patient to get out of the bed. The currently known bed enclosures do not move up and down with the bed.

Another embodiment of the bed enclosure includes a bed and an enclosure which encloses at least the occupant portion of the bed. The enclosure comprises a plurality of panels. At least one of the panels is removably attached to the enclosure. In a preferred embodiment, the enclosure includes a frame and a netted covering which extends over the frame. Preferably, the netted covering comprises a plurality of separate covering panels, each of which is removably attached to the frame. The currently known netted coverings for bed enclosures are large one-piece coverings. The netted covering of the invention is easier to wash than a one-piece covering, because the covering panels can be removed and washed separately. The netted covering has the additional advantage that if a portion of the covering needs replacement, it is only necessary to replace one of the covering panels, not the entire covering.

Other advantages of this invention will become apparent to those skilled in the art from the following detailed description of the preferred embodiments, when read in light of the accompanying drawings.

DETAILED DESCRIPTION OF THE INVENTION

Figure 1:
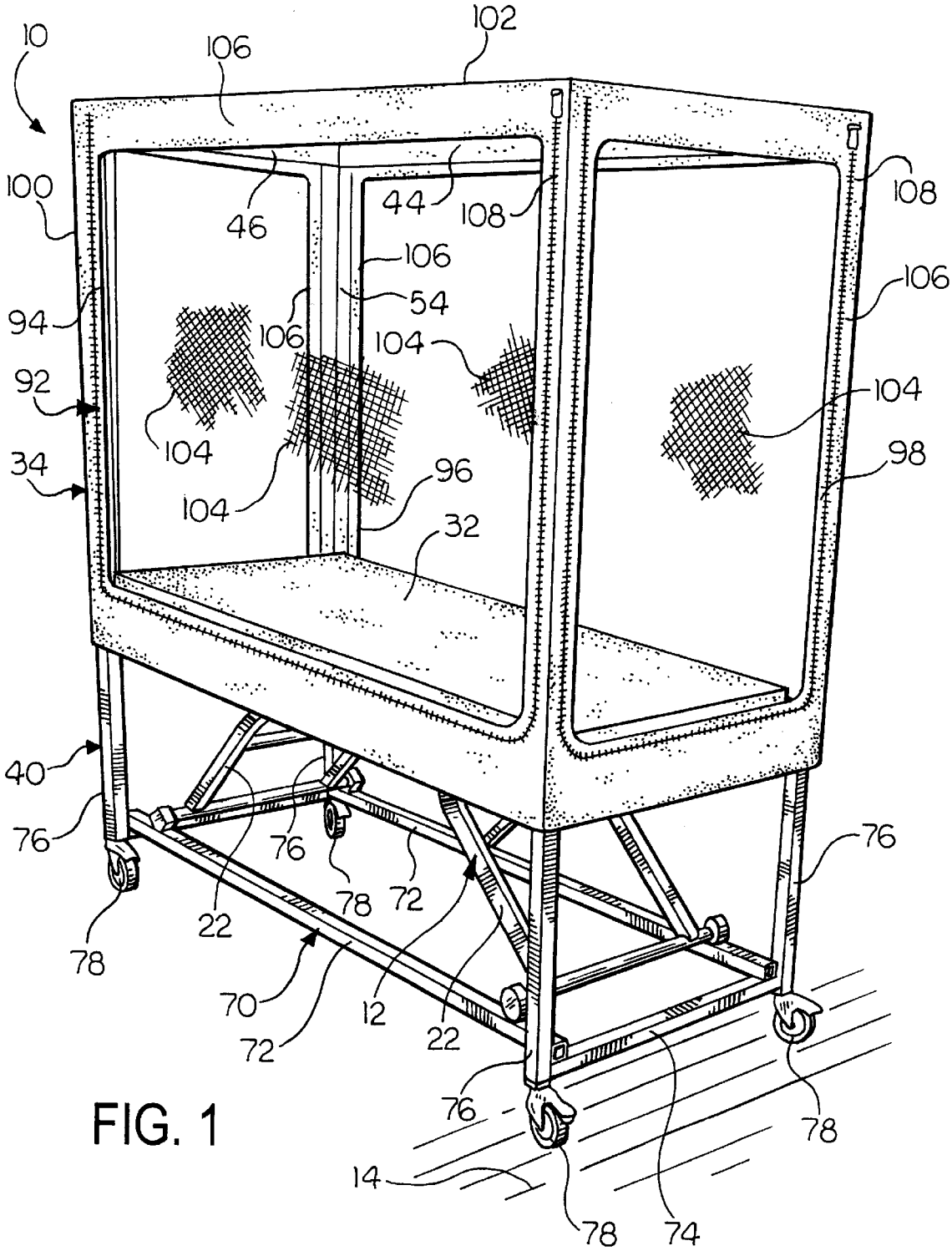
FIG. 1 is a perspective view of a bed enclosure in accordance with the invention.

In the following description of the invention, certain terminology will be used for the purpose of reference only, and is not intended to be limiting. Terms such as "up" and "down" refer to directions in the drawings to which reference is made. Terms such as "upper", "lower", "top", "bottom", "side", "end", "horizontal", and "vertical" describe the orientation of portions of the bed enclosure within a consistent but arbitrary frame of reference which is made clear by reference to the text and the associated drawings describing the bed enclosure under discussion. Such terminology will include the words specifically mentioned above, derivatives thereof, and words of similar import.

Figure 2:
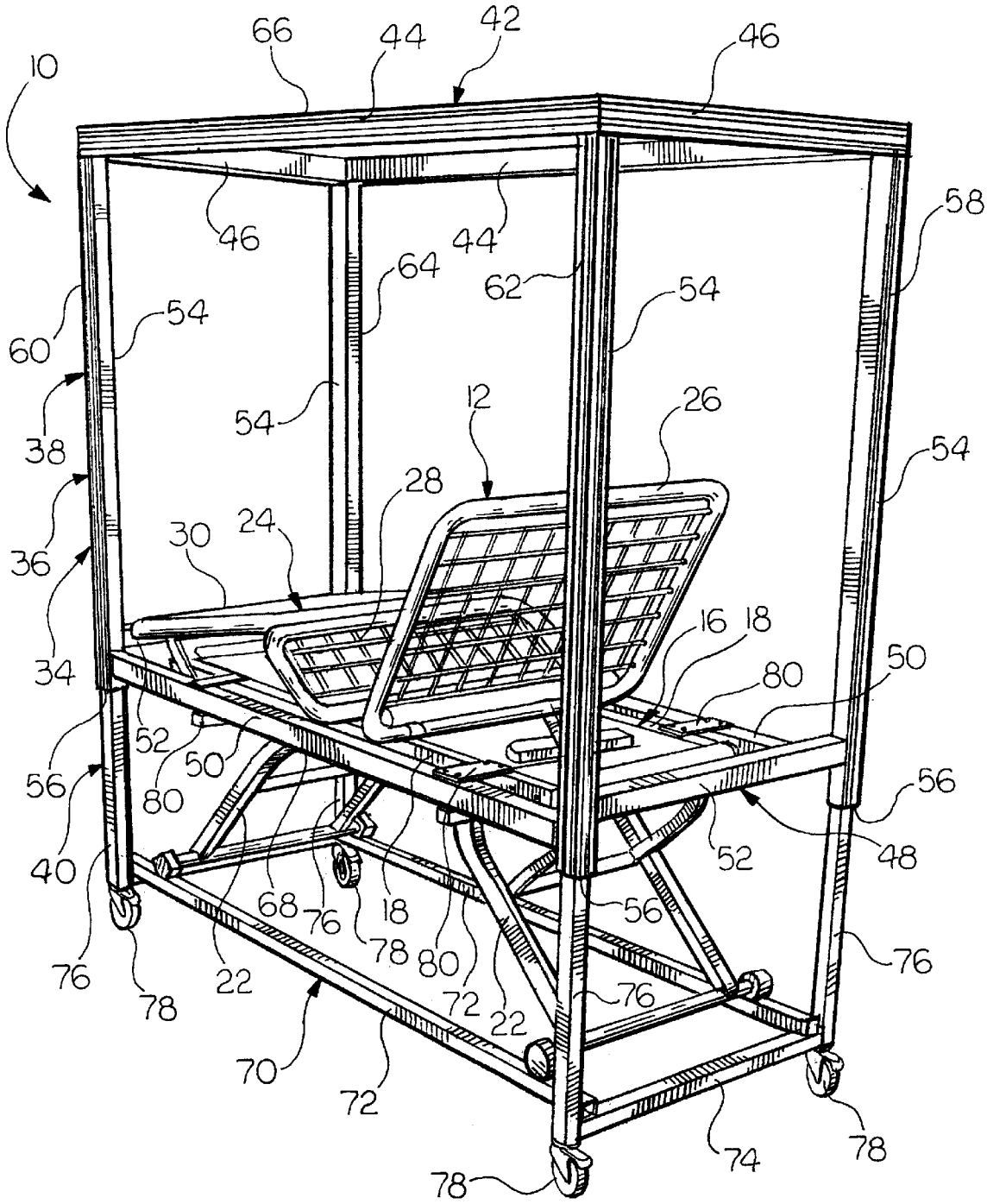
FIG. 2 is a view like in FIG. 1, except showing the bed with the netted covering of the bed enclosure removed to expose the bed frame.
Figure 3:
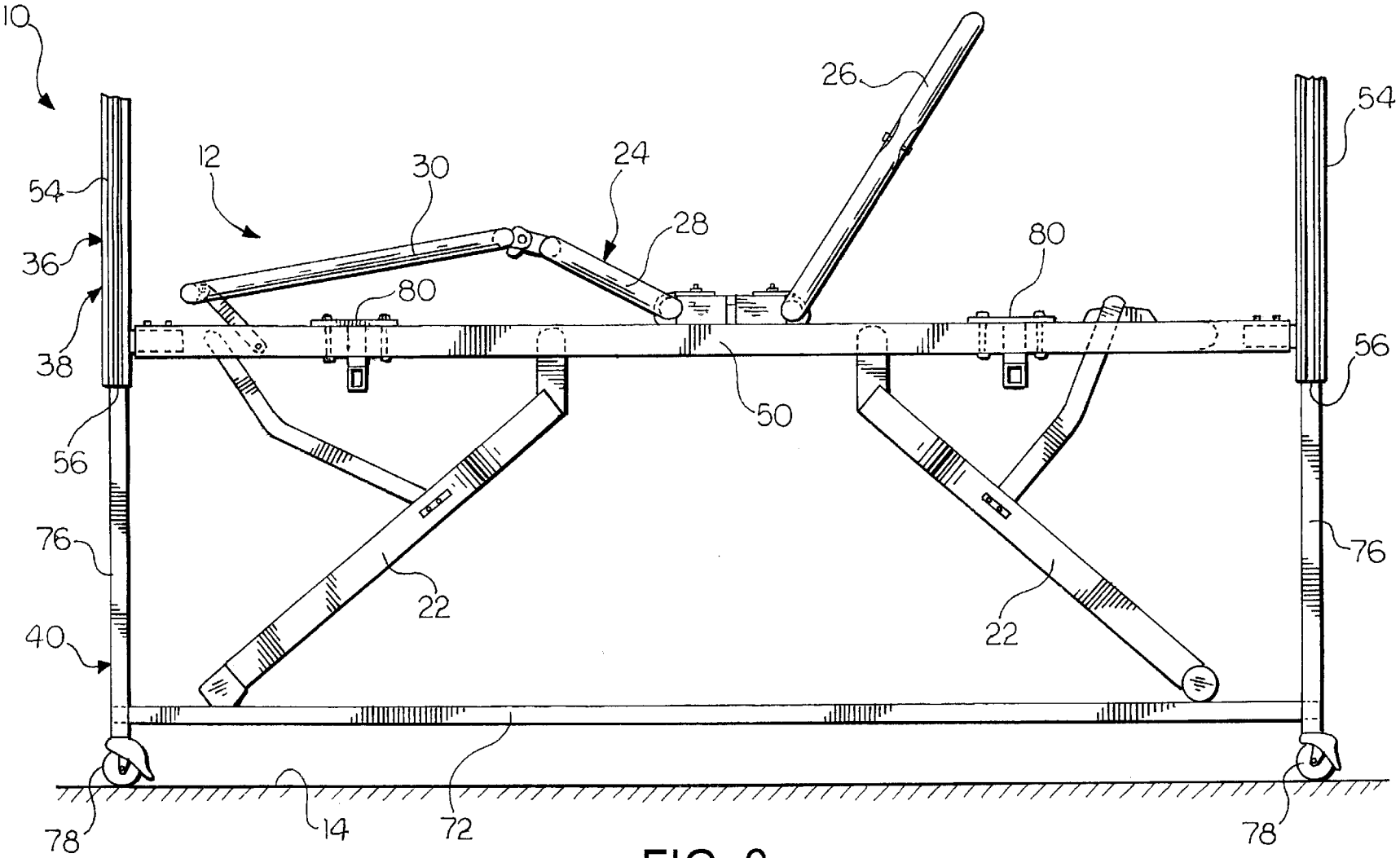
FIG. 3 is a side view of a portion of the bed enclosure of FIG. 2.

Referring now to the drawings, there is illustrated in FIGS. 1–3 a bed enclosure, indicated generally at 10, in accordance with the invention. The bed enclosure 10 includes a bed 12 which is adapted to move up and down relative to a resting surface 14 beneath the bed, such as a floor 14. The bed 12 can have any suitable construction; different constructions of beds which can move up and down relative to a floor are well known. Although this invention will be described and illustrated in conjunction with the particular bed disclosed herein, it will be appreciated that the invention can be used in connection with other beds. Thus, only those portions of the bed which are necessary for a full understanding of the invention will be explained and illustrated in detail. The illustrated bed enclosure is similar to that disclosed in U.S. Pat. Nos. 5,384,925 and 5,784,732 to Vail, the disclosures of both of these patents incorporated herein by reference.

Figure 4:
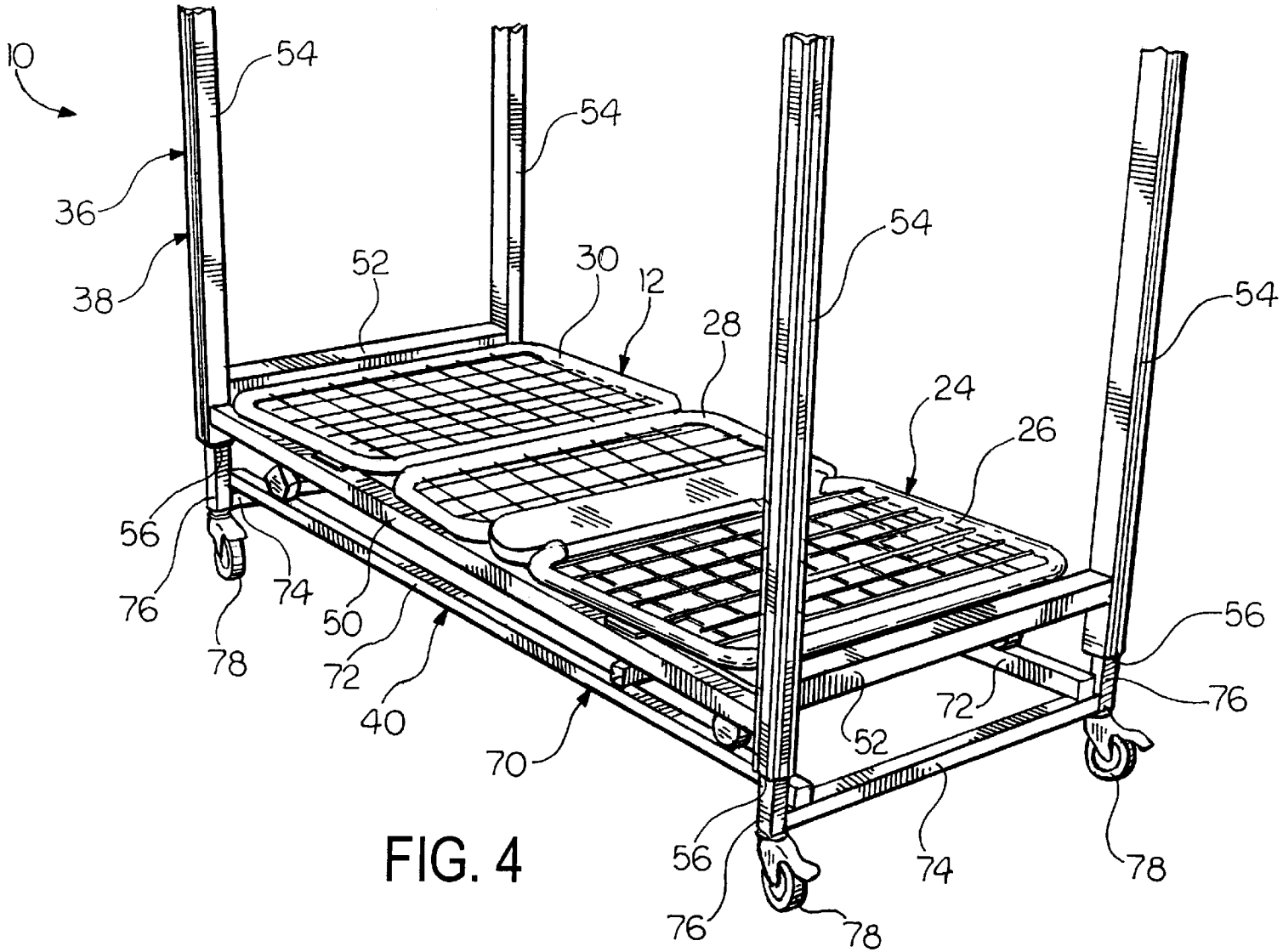
FIG. 4 is a perspective view of a portion of the bed enclosure of FIG. 2, except showing the bed and the frame in a lowered position.
Figure 5:
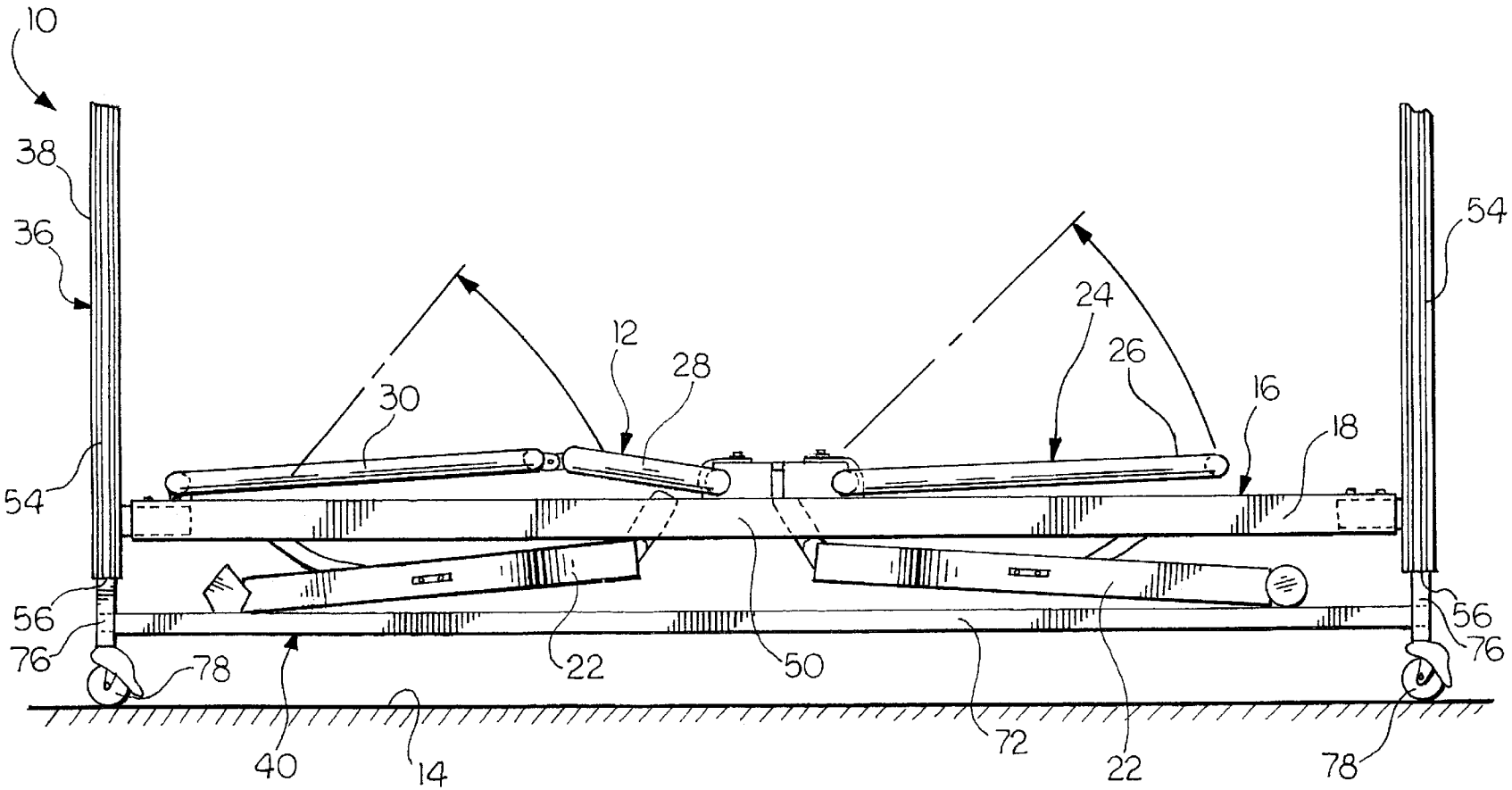
FIG. 5 is a side view of the bed enclosure of FIG. 4.
Figure 6:
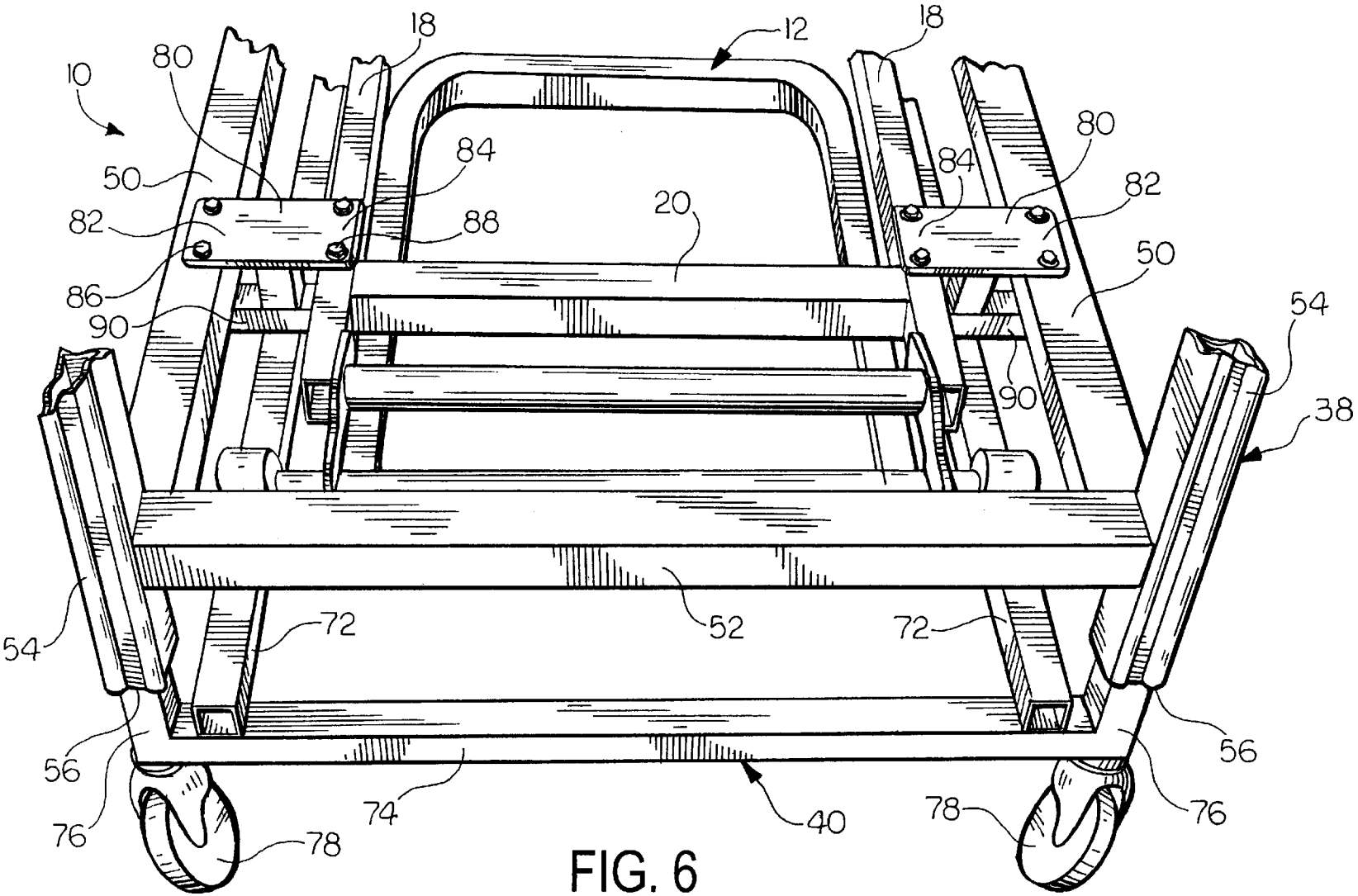
FIG. 6 is an end view of the bed enclosure of FIG. 4.

In the illustrated embodiment, the bed 12 includes a horizontally oriented bed frame 16 which is rectangular in shape. The bed frame 16 includes a pair of longitudinally extending side posts 18, and a pair of transversely extending end posts 20 (one of which is shown in FIG. 6). The bed 12 includes a pair of legs 22 which are pivotably mounted on the bottom of the bed frame 16. The legs 22 are extendable for moving the bed 12 up in an extended or raised position, and retractable for moving the bed 12 down in a retracted or lowered position. FIGS. 1–3 show the bed 12 in the raised position, while FIGS. 4 and 5 show the bed 12 in a lowered position. Any suitable mechanism (not shown) can be used for raising and lowering the bed 12, including different types of powered and/or manual mechanisms. A bedspring or mattress support assembly 24 is mounted on top of the bed frame 16. The bedspring assembly 24 includes a head portion 26, a middle portion 28 and a foot portion 30. A bed mattress 32 (shown in FIG. 1) rests on top of the spring assembly 24. The head portion 26 and foot portion 30 of the spring assembly 24 can be raised (shown in FIGS. 2 and 3) to raise the associated head and foot sections of the mattress 32.

The bed enclosure 10 of the invention also includes a bed enclosure frame 34. The bed enclosure frame 34 encloses at least the occupant portion of the bed 12 (i.e., generally the top portion of the bed 12, where a person occupying the bed 12 is located). In the illustrated embodiment, the bed enclosure frame 34 encloses the occupant portion of the bed 12, and it extends around (but does not completely enclose) the entire bed 12. The bed enclosure frame 34 can be a separate structure from the bed 12, or it can be formed as part of the bed 12. In the embodiment shown, the bed enclosure frame 34 is a separate structure which is attached to the bed 12 (the attachment is described below). The illustrated bed enclosure frame 34 includes a bed enclosure frame assembly 36 which is attached to the bed 12.

The illustrated bed enclosure frame assembly 36 includes a top frame 38 and a bottom frame 40. The top frame 38 is rectangular in shape, including a horizontally oriented upper portion 42 which includes a pair of longitudinally extending upper side posts 44 and a pair of transversely extending upper end posts 46. The top frame 38 further includes a horizontally oriented lower portion 48 which includes a pair of longitudinally extending lower side posts 50 and a pair of transversely extending lower end posts 52. Four vertically oriented corner posts 54 extend between the associated corners of the upper portion 42 and the lower portion 48. In the illustrated embodiment, the corner posts 54 are hollow tubes, each having an opening 56 at the bottom of the tube for a purpose described below. As shown in FIG. 2, the top frame 38 defines a pair of opposed ends 58, 60, a pair of opposed sides 62, 64, a top 66, and a bottom 68.

The bottom frame 40 includes a horizontally oriented lower portion 70 which includes a pair of longitudinally extending lower side posts 72 and a pair of transversely extending lower end posts 74. The legs 22 of the bed 12 rest on the lower side posts 72 in the embodiment shown. Four vertically oriented corner posts 76 extend upward from the associated corner of the lower portion 70. Preferably, the posts 72, 74 and 76 of the bottom frame 40 and the posts 44, 46, 50, 52 and 54 of the top frame 38 are constructed of hollow aluminum tubes which are welded together to form the respective frames 40 and 38. The illustrated bottom frame 40 is adapted to rest on the floor 14. In the illustrated embodiment, casters 78 are attached to the lower ends of the corner posts 76 to facilitate movement of the bed enclosure 10.

The top frame 38 of the bed enclosure frame 34 of the invention is adapted to move up and down with the bed 12, so that the bed enclosure 12 is raised and lowered along with the movement of the bed 12. The bed enclosure frame 34 can have any structure which is suitable for achieving such movement. In the illustrated embodiment, the top frame 38 is adapted to move up and down relative to the bottom frame 40, so that the bed enclosure 34 can move up and down with the bed 12. The illustrated corner posts 76 of the bottom frame 40 are aligned with the corner posts 54 of the top frame 38 so that the posts 76 and 54 are telescopically disposed relative to one another. To accomplish this, in the illustrated embodiment, the corner posts 54 of the top frame 38 are hollow rectangular shaped tubes which define the opening 56 which is slightly larger than that of the upper end of the corner posts 76 of the bottom frame 40. As a result, the corner posts 76 of the bottom frame 40 are telescopically received inside the corner posts 54 of the top frame 38 to enable the top frame 38 to move up and down relative to the bottom frame 40. Alternatively, the configuration of the top frame and/or the bottom frame 40 can be other than illustrated if desired.

Figure 7:
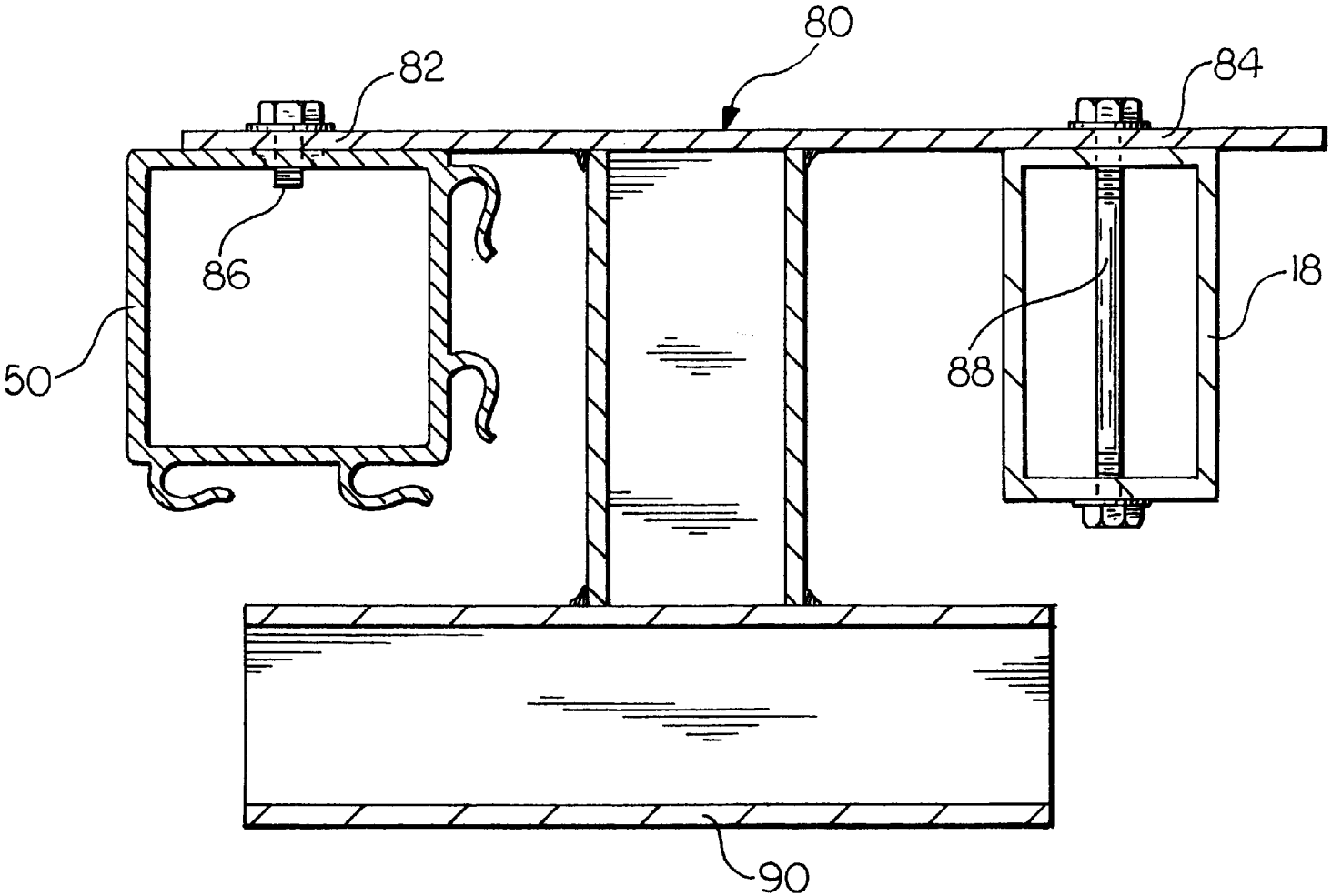
FIG. 7 is a cross-sectional view of a portion of the bed enclosure of FIG. 2, showing a bracket attaching a bed side post to a frame side post.

In the illustrated embodiment, the top frame 38 is moved up or down relative to the bottom frame 40 when the bed 12 to which it is attached moves up or down. The top frame 38 can be attached to the bed 12 in any suitable manner which allows such movement. As best shown in FIGS. 6 and 7, the illustrated bed enclosure 12 has the top frame 38 attached to the bed 12 by a plurality of brackets 80 which operatively couple the top frame 38 and the bed 12 together for movement with one another. Any suitable type of brackets 80 can be used for this purpose. In the embodiment shown, each of the brackets 80 includes a first attachment portion 82 which is attached to an associated lower side post 50 of the top frame 38, and a second attachment portion 84 which is attached to an associated side post 18 of the bed 12. The side posts 12 and 50 can be attached to the bracket 80 by any suitable means, such as by respective bolts 86 and 88 in the illustrated embodiment. The illustrated bracket 80 also includes a third attachment portion 90 which is adapted for attachment to another structure of the bed enclosure 12, such as a bed side rail (not shown) which assists in retaining the occupant in the bed 12, or a bed foot rest (not shown) which assists the occupant in getting into and out of the bed 12. Alternatively, the structure of the bracket 80 can be other than illustrated if so desired. Also, as discussed above, if it is desired to make the bed enclosure frame 34 part of the bed 12, the side post 50 could replace the side 18.

As shown in FIGS. 1 and 2, the preferred embodiment of the bed enclosure 34 frame includes a covering 92 which extends over the top frame 38. In the embodiment shown, the covering 92 is made up of individual or separate side panels 94 and 96 and individual or separate end panels 98 and 100 which extend over the sides 62 and 64 and ends 58 and 60 of the top frame 38, respectively; a top panel 102 which extends over the top 66 of the top frame 38; and a bottom panel (not shown) which extends over the bottom of the top frame 38 (under the mattress 32). Preferably, the covering 92 includes at least a portion which is netted to allow easy visibility in and out of the bed enclosure frame 34 while retaining the occupant thereinside. In the illustrated embodiment, the covering 92 includes netted portions 104 on the side panels 94 and 96 and end panels 98 and 100 of the covering 92, while the top panel 102 and the bottom panel are solid material. Specifically, the side panels 94 and 96 and the end panels 98 and 100 of the covering 92 each include a solid portion 106 around the perimeter thereof, and a netted portion 104 in the middle thereof. The panels 94, 96, 98 and 100 preferably each include zippers 108 to allow the panels to be easily opened and closed, in order to provide access to the interior of the bed enclosure frame 34. The solid portion 106 of the panels 94, 96, 98 100 and 102 can be any suitable material, such as vinyl. The netted portion 104 of the panels 94, 96, 98 and 100 can be any netting material which is strong enough to retain the occupant inside the bed enclosure frame 34, such as thick nylon or plastic netting.

Advantageously, at least one of the covering panels 94, 96, 98, 100 and 102 (and the bottom panel) is removably attached to the bed enclosure 34. Preferably, at least two of the covering panels, such as the side panels 94 and 96, are removably attached. More preferably, at least four of the covering panels, such as the side panels 94 and 96 and the end panels 98 and 100, are removably attached. In the embodiment shown, the bed enclosure frame 34 is constructed so that all of the covering panels 94, 96, 98, 100 and 102 (and the bottom panel) are removably attached to the bed enclosure frame 34.

Figure 8:
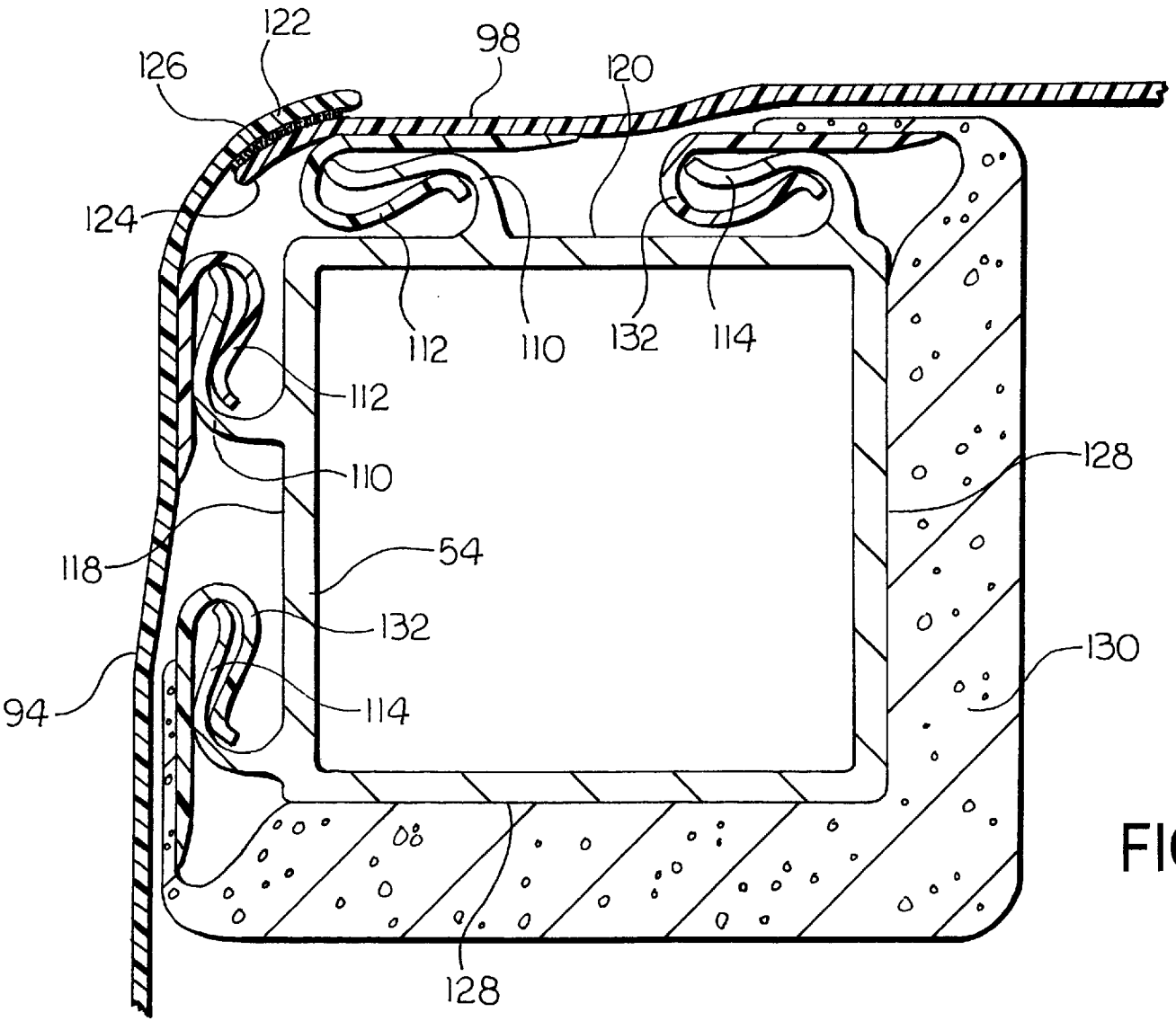
FIG. 8 is a cross-sectional view of a corner post of the bed of FIG. 1, showing a pair of covering panels and a padding material removably attached to the corner post.
Figure 9:
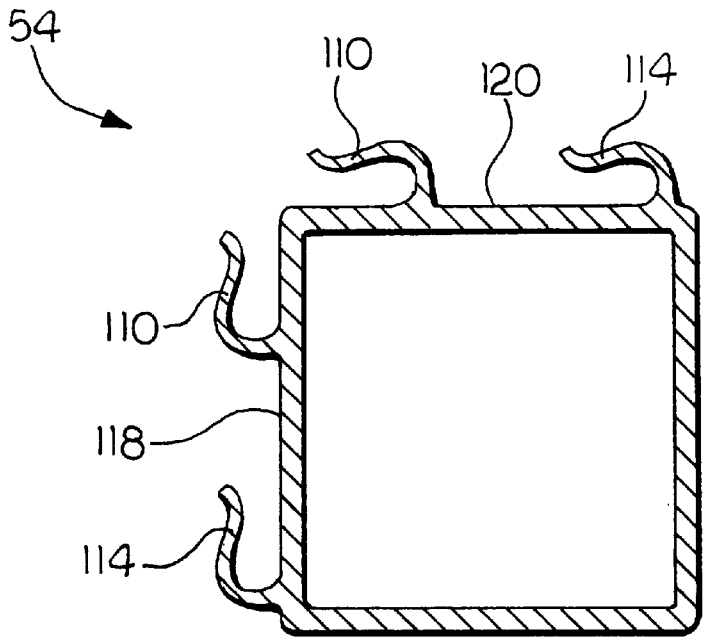
FIG. 9 is a cross-sectional view of the corner post of FIG. 8.
Figure 10:
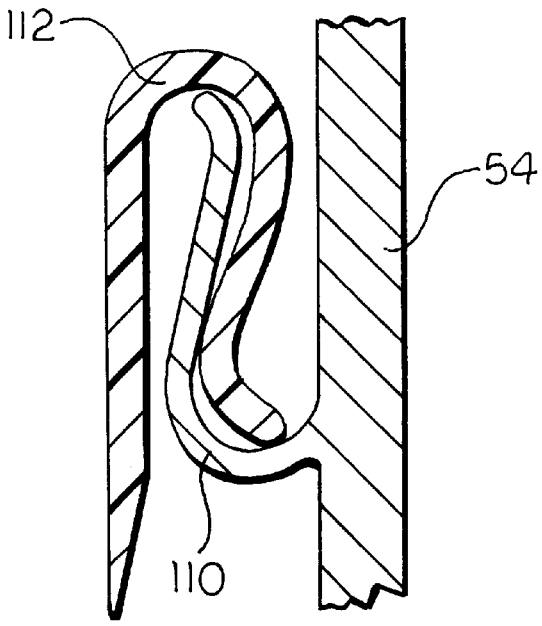
FIG. 10 is an enlarged cross-sectional view showing a hook portion of one of the covering panels of FIG. 8 attached to a hook portion of the corner post.

The covering panels 94, 96, 98, 100 and 102 (and the bottom panel) can be removably attached to the bed enclosure frame 34 by any suitable means. In the illustrated embodiment, the top frame 38 and the covering panels 94, 96, 98, 100 and 102 (and the bottom panel) are constructed with respective cooperating hook portions 110 and 112 (shown in FIGS. 8–10) for removably attaching the covering panels to the top frame 38. The hook portions 110 extend along the side posts 44 and 50, the end posts 46 and 52, and the corner posts 54 of the top frame 38, and the hook portions 112 extend along the edges of the associated covering panels 94, 96, 98, 100 and 102 (and the bottom panel). As shown in FIGS. 8–10, the corner post 54 of the top frame 38 is constructed with a pair of hook portions 110 and 114 on a side surface 118 of the corner post 54, and another pair of hook portions 110 and 114 on an end surface 120 of the corner post 54. The side panel 94 of the covering 92 has a hook portion 112 attached inside the edge of the side panel 94, and the end panel 98 of the covering 92 has a hook portion 112 attached inside the edge of the end panel 98. The hook portions 112 of the side panel 94 and the end panel 98 are adapted to be removably attached to the hook portions 110 on the side surface 118 and the end surface 120 of the corner post 54, respectively. The hook portions 110, 112 on the corner posts 54 and the covering panels 94, 98 can be any type of hook portions suitable for removably attaching the covering panels 94, 98 to the corner posts 54. Preferably, at least one of the cooperating hook portions 110, 112 is made from an elastic material. In the embodiment shown, the hook portions 110 on the corner posts 54 are longitudinally extending J-shaped channels formed integrally with the posts 54, and the hook portions 112 on the covering panels 94 and 98 are pieces of J-shaped plastic molding attached to the edges of the panels 94 and 98, such as by sewing or adhesive. Preferably, the edges of the panels 94 and 98 overlap to hide the top frame 38. As shown in FIG. 8, the edge 122 of the side panel 94 overlaps the edge 124 of the end panel 98, and the edges 122 and 124 are releasably held together by hook and loop fasteners 126 (e.g., VELCRO) or other means.

Preferably, the inner sides 128 of the top frame 38 are covered with padding 130 to protect the occupant of the bed enclosure 12. In the embodiment shown in FIG. 8, the inner sides 128 of the corner posts 54 are covered with a padding material 130 which is removably attached to the post 54. Specifically, the padding material 130 has hook portions 132 attached to the edges of the padding material 130, and the hook portions 132 are adapted to be removably attached to corresponding hook portions 114 on the side surface 118 and end surface 120 of the corner post 54. Any suitable hook portions 114 and 132 can be used, such as the J-shaped channels and J-shaped molding described above. Alternatively, the structure and/or method of attaching the panels 94, 96, 98, 100 and 102 (and the bottom panel) and/or the padding material 120 to the top frame 38 can be other than illustrated.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A bed enclosure comprising:

a bed moveable up and down relative to a resting surface beneath said bed; and an enclosure which encloses at least an occupant portion of said bed, and which is moveable up and down along with the movement of said bed;

wherein said enclosure includes a top frame which is attached to said bed, and a bottom frame which stands on the resting surface, and wherein said top frame moves up and down relative to said bottom frame.

2. The bed enclosure defined in claim 1 wherein said top frame and said bottom frame each include a plurality of vertically oriented posts, and wherein said posts of said top frame are telescopically disposed relative to said posts of said bottom frame to enable said top frame to move up and down relative to said bottom frame.

3. A bed enclosure comprising:

a bed moveable up and down relative to a resting surface beneath said bed; and an enclosure which encloses at least an occupant portion of said bed, and which is moveable up and down along with the movement of said bed;

wherein said enclosure includes a frame which is attached to said bed, and a covering which extends over said frame, said covering having a netted portion;

wherein said frame is attached to said bed with a plurality of brackets; and wherein said brackets include a first attachment portion attached to a horizontally oriented portion of said frame, a second attachment portion attached to a horizontally oriented portion of said bed, and a third attachment portion attached to a side rail.

4. A bed enclosure comprising:

a bed; and an enclosure which encloses at least an occupant portion of the bed, said enclosure comprising a plurality of panels;

at least one of said panels having removable attachment means for removably attaching the panel to the enclosure, so that the panel can be detached and completely separated from the enclosure, and a zipper located inward from the attachment means to allow opening and closing of the panel when the panel is attached to the enclosure.

5. The bed enclosure defined in claim 4 wherein all of said panels are removably attached to said enclosure.

6. The bed enclosure defined in claim 4 wherein at least one of said panels includes a netted portion.

7. The bed enclosure defined in claim 4 wherein said panels form a covering of said enclosure, and wherein said enclosure further includes a frame over which said covering extends.

8. The bed enclosure defined in claim 7 wherein edges of said panels overlap to hide said frame.

9. A bed enclosure comprising:

a bed; and an enclosure which encloses at least an occupant portion of the bed, said enclosure comprising a plurality of panels, at least one of said panels being removably attached to said enclosure so that the panel can be detached and completely separated from the enclosure;

wherein said panels form a covering of said enclosure, and wherein said enclosure further includes a frame over which said covering extends; and wherein said at least one removably attached panel is removably attached to said frame by cooperating hook portions provided on said panel and said frame.

10. The bed enclosure defined in claim 9 wherein at least one of said hook portions on said panel and said frame is made from an elastic material.

11. The bed enclosure defined in claim 9 wherein said hook portion on said side panel comprises a J-shaped molding and said hook portion on said frame comprises a J-shaped channel.

12. The bed enclosure defined in claim 9 further including a padding material removably attached to said frame by cooperating hook portions on said padding material and said frame.

13. A bed enclosure comprising:

a bed which is moveable up and down relative to a resting surface beneath said bed; and an enclosure which encloses at least an occupant portion of said bed, and which is moveable up and down with said bed, said enclosure comprising a plurality of panels, at least one of said panels being removably attached to said enclosure;

wherein said enclosure includes a top frame which is attached to said bed, and a bottom frame which is adapted to stand on the resting surface, and wherein said top frame is adapted to move up and down relative to said bottom frame.

14. The bed enclosure defined in claim 13 wherein all of said panels are removably attached to said enclosure.

* * * * *